US006308622B1

(12) United States Patent
Steffen et al.

(10) Patent No.: US 6,308,622 B1
(45) Date of Patent: Oct. 30, 2001

(54) ROTARY PRINTING MACHINE

(75) Inventors: Volker Steffen, Herford; Michael Voigt, Kirchlengern, both of (DE)

(73) Assignee: Werner Kammann Maschinenfabrik GmbH, Bünde (DE)

( * ) Notice: Subject to any disclaimer, the term of this patent is extended or adjusted under 35 U.S.C. 154(b) by 0 days.

(21) Appl. No.: 09/385,289

(22) Filed: Aug. 30, 1999

(51) Int. Cl.[7] ..... B41F 13/24; B41F 1/34; B41F 21/12; B41F 21/14; B41F 3/08

(52) U.S. Cl. ..... 101/248; 101/479; 101/481

(58) Field of Search ..... 101/248, 368, 101/479–481, 485, 216, 181, 183, 375; 492/45; 464/162; 384/9, 24

(56) References Cited

U.S. PATENT DOCUMENTS

| | | | |
|---|---|---|---|
| 1,328,842 | 1/1920 | Marquardt . | |
| 3,143,962 | 8/1964 | Dobson et al. | 101/248 |
| 3,724,367 * | 4/1973 | Pasinski | 101/110 |
| 3,750,568 * | 8/1973 | Weisgerber | 101/248 |
| 4,512,256 * | 4/1985 | Schriber et al. | 101/248 |
| 5,255,604 * | 10/1993 | Durr | 101/389.1 |

FOREIGN PATENT DOCUMENTS

| | | |
|---|---|---|
| 2365201 | 6/1975 | (DE) . |
| 9113505 | 2/1992 | (DE) . |

* cited by examiner

*Primary Examiner*—Kimberly L. Asher
(74) *Attorney, Agent, or Firm*—Drinker Biddle & Reath LLP

(57) ABSTRACT

A device for use in a rotary printing machine having at least one printing mechanism including a plate cylinder which can be releasably mounted on a shaft carrying the plate cylinder. The plate cylinder and the shaft can be oriented both axially and also in the peripheral direction relative to the shaft and thus relative to the article to be printed. When the plate cylinder and the shaft are oriented as desired, the plate cylinder is capable of being fixedly attached to the shaft. The plate cylinder can be fixed in the peripheral direction and in the axial direction.

11 Claims, 3 Drawing Sheets

FIG.8
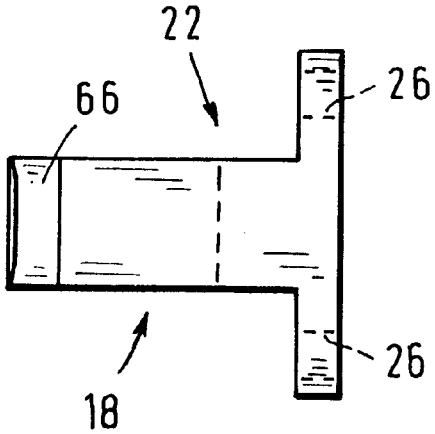
FIG.7
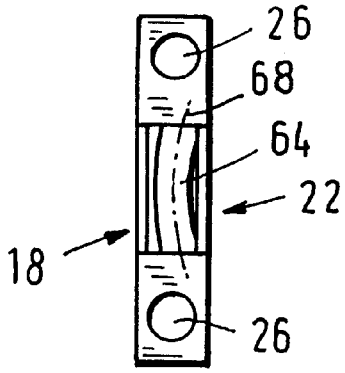
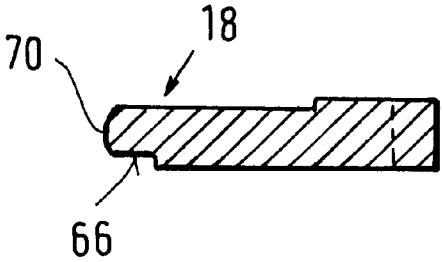
FIG.9

ROTARY PRINTING MACHINE

FIELD OF THE INVENTION

The invention concerns a device for use in a rotary printing machine.

BACKGROUND OF THE INVENTION

A typical form of rotary printing machine has at least one printing mechanism including a plate cylinder which can be releasably mounted to a shaft carrying it. The plate cylinder carries a printing plate which is fixedly connected thereto. If the printing plate is provided with the respective print image to be produced, in a special imaging or image-applying apparatus, that is to say outside the printing mechanism itself, it is then necessary for the printing or blanket cylinder, upon being fitted into the printing mechanism, to be properly oriented with respect to the shaft which carries it, in such a way that the print image which is transferred from the printing plate on to the printing cylinder is correctly oriented with respect to the article to which the printing is to be applied and on to which therefore the printing or blanket cylinder transfers the print image. In view of the fact that in many cases the number of articles to which printing is to be applied in the same fashion, that is to say the number of articles constituting a respective batch, may be very low, there is a need for the printing plate to be changed at short intervals of time. If the printing plate is fixedly connected to the plate cylinder, frequent changes in the printing plate entail correspondingly frequent changes in the plate cylinder. The amount of time that this involves is particularly significant when, as is normally always the case in offset printing, the article is to be successively provided with a plurality of partial print images each consisting of different colors or inks, which supplement each other to form an overall print image. This therefore requires a corresponding number of printing mechanisms and accordingly also plate cylinders, in the rotary printing machine.

SUMMARY OF THE INVENTION

An object of the present invention is to provide a rotary printing machine which permits plate cylinder changes to be implemented in a simple fashion involving a minimum amount of time.

Another object of the present invention is to provide a rotary printing machine affording a structure such as to permit accurate adjustment of the respective plate cylinder so as to satisfy the nowadays usual demands in terms of print image quality.

Still a further object of the present invention is to provide a rotary printing machine affording adjustability of plate cylinder and print image such as to satisfy the particularly high demands in terms of accuracy of adjustment which are involved when an article to be provided with printing thereon is to be successively provided with a plurality of partial print images which must be accurately positioned relative to each other.

In accordance with the principals of the present invention the foregoing and other objects are obtained by a rotary printing machine having at least one printing mechanism which includes a plate cylinder which can be releasably mounted on a shaft carrying it. The plate cylinder and the shaft are adapted to as to enable orientation of the plate cylinder relative to its shaft both axially and also in a peripheral direction, and for fixing the plate cylinder to a shaft in an oriented position with respect thereto. The plate cylinder includes a means of positioning which comprises a first and second projection. Associated with the shaft is an adjustment means for adjusting the position of the positioning means enabling the plate cylinder to be positioned as desired. The adjustment means comprises a first and second adjustable bolt. The first projection is co-operable with the first adjustable bolt which is operatively associated with the shaft for fixing the position of the plate cylinder in the peripheral direction. The second projection is co-operable with the second adjustable bolt which is operatively associated with the shaft to fix the axial position of the plate cylinder relative to the shaft. The first and second adjustable bolts include a region against which the respective positioning means come to bear so as to enable convenient and accurate positioning of the plate cylinder in either the peripheral direction or the axial direction.

In accordance with a preferred feature of the invention, operatively associated with the plate cylinder is a collar which is also arranged on the drive shaft thereof and which is provided with the adjustable bolts, while the-first and second projections located on the plate cylinder are introduced into openings in the collar that are brought into contact in the openings with the adjustable bolts which determine the position of the plate cylinder both axially and also in the peripheral direction.

In accordance with a further preferred feature of the invention the use of conically tapering portions of said bolts which are adjustable in the direction of the longitudinal axis thereof affords the advantage that the operating position of the plate cylinder can be very accurately adjusted relative to the shaft by simple axial displacement of the conically tapering portion.

An operating procedure which has been found to be particularly advantageous is one in which the imaging apparatus is also so designed that the positioning of the plate cylinder in the imaging apparatus is in conformity with the positioning thereof in the printing mechanism so that it is only necessary for the imaged plate cylinder to be removed from the imaging apparatus and fitted on to the drive shaft in the printing mechanism, whereupon, using the arrangement according to the invention, orientation thereof can be effected therein, relative to the shaft, without each change in plate cylinder necessitating displacement of the conically tapering portions for the purposes of adjusting the position of the plate cylinder in the axial direction and in the peripheral direction. On the other hand however the invention also permits fast and in particular accurate adjustment of the plate cylinder in a simple fashion in the situations in which the conically tapering portions for determining the position of the plate cylinder on the shaft have to be set for the first time or re-adjusted so that a fast change of the plate cylinders including accurate adjustment thereof is possible even when the position of the plate cylinder in the imaging apparatus is not defined in relation to the position of the plate cylinder in the printing mechanism.

It will be appreciated that it is assumed in all cases that the position of the plate which is respectively carried by the plate cylinder is accurately fixed and defined in relation to the plate cylinder.

Further objects, features and advantages of the invention will be apparent from the following description of a preferred embodiment of the invention.

BRIEF DESCRIPTION OF THE DRAWING

FIG. 7 shows a detail from FIG. 2 on an enlarged scale, FIG. 8 shows a plan view of the detail in FIG. 7, and FIG. 9 is a view in longitudinal section of the detail of FIG. 7.

DESCRIPTION OF THE PREFERRED EMBODIMENT

Figure 1:
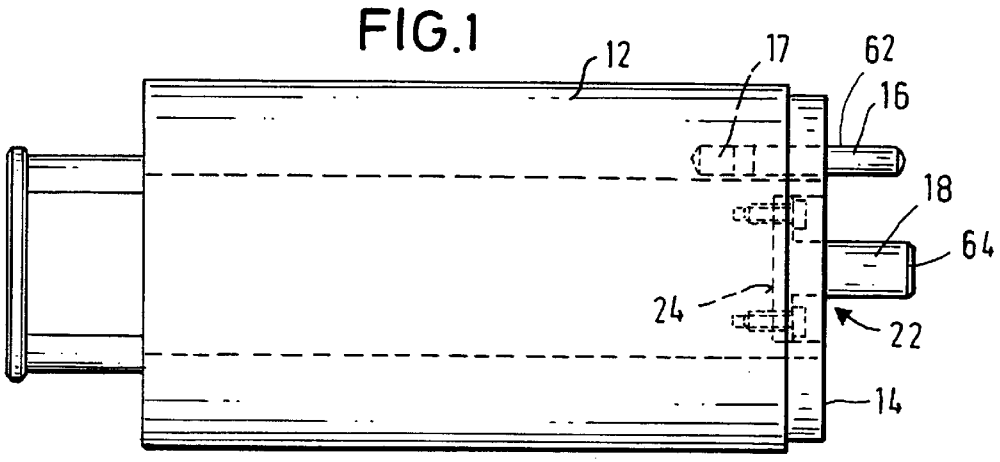
FIG. 1 is a side view of a plate cylinder.
Figure 2:
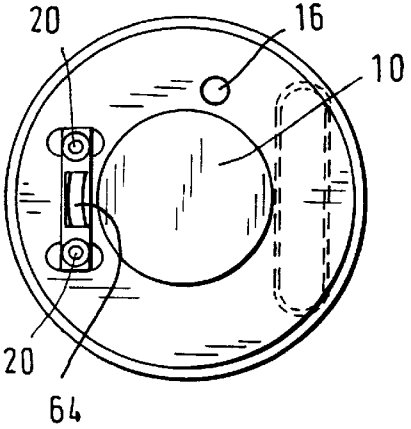
FIG. 2 shows a front view of the FIG. 1 structure.
Figure 3:
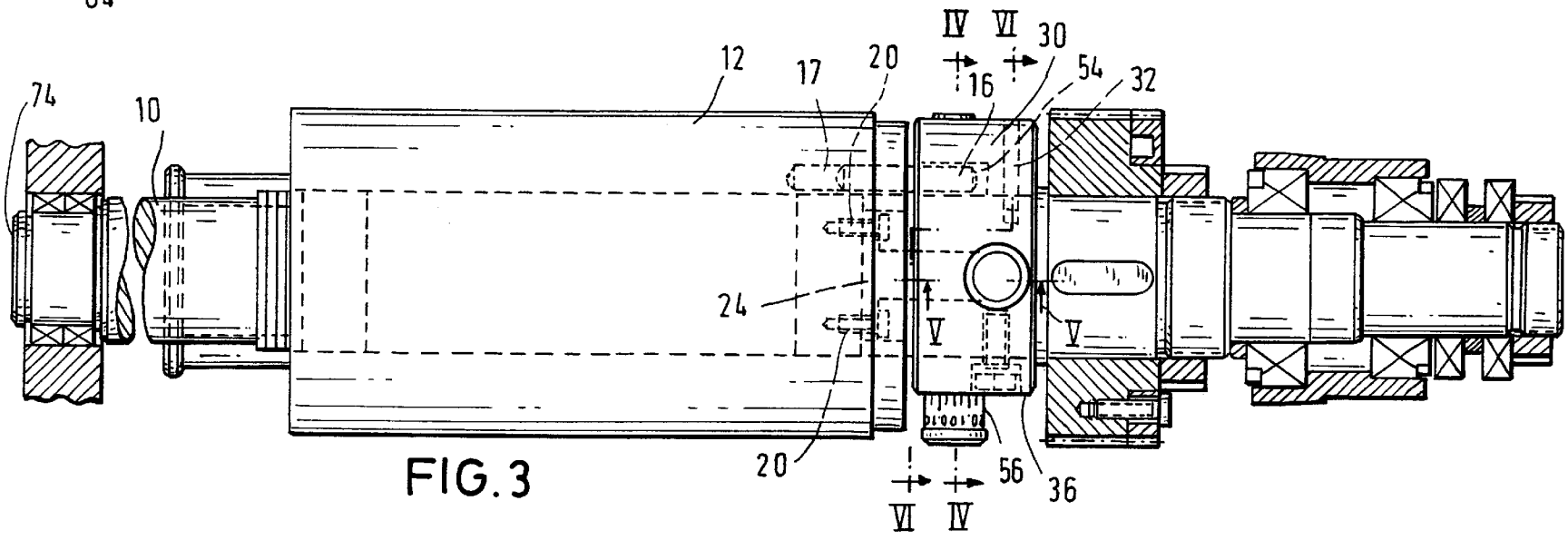
FIG. 3 is a side view of a unit comprising a drive shaft, a plate cylinder and associated components.

Referring firstly to FIGS. 1 through 3, reference numeral 10 denotes a mounting shaft of a printing mechanism of which at least one is contained in a rotary printing machine. The at least one printing mechanism further includes a plate cylinder which is generally indicated at 12 and which is mounted releasably and thus interchangeably on the shaft 10 which carries it. Connected upstream of the plate cylinder 12 in the printing mechanism is an ink roller (not shown). The plate cylinder 12 carries a printing plate (not shown) which has been provided with the appropriate print image to be applied to an article. The ink which is applied to the printing plate by the inking roller is transferred in accordance with the print image on to the printing blanket of the printing or blanket cylinder (not shown) which also forms part of the printing mechanism, and from the blanket on to the article to which the printing is to be applied. It will be appreciated that the arrangements and operating procedures just outlined above are readily familiar to the man skilled in the art for example in connection with offset printing machines so that details thereof do not need to be particularly described herein.

The printing plate which in operation of the printing mechanism is carried on the plate cylinder 12 is provided with the appropriate print image in a separate special image-applying or imaging station, for example by means of a laser. Thereupon the plate cylinder 12 is fitted on to the shaft 10 and secured thereto. As it is necessary for the print image and therewith the printing plate to be oriented in a specifically defined manner with respect to the article to which printing is to be applied, the plate cylinder 12 has to be suitably oriented with respect to the drive and mounting shaft 10 on which it is driven in rotation.

For that purpose, the plate cylinder 12 is provided with a means of positioning adapted to work together with an adjustment means so as to enable the convenient and accurate positioning of the plate cylinder. In a preferred embodiment, the means of positioning includes a first projection 16 and a second projection 18. The first projection 16 serves to fix the position of the plate cylinder with respect to the shaft in the peripheral direction of the shaft 10 and the plate cylinder 12. The first projection 16 illustrated in this embodiment is in the form of a cylindrical pin which is inserted in a bore 17 at the one end of the plate cylinder 12 and forms a projection which protrudes with respect to the end face 14 of the plate cylinder 12. It should be understood however that the pin may be formed in any shape.

The second projection 18 serves for fixing the position of the plate cylinder 12 relative to the shaft 10 in the direction of the longitudinal axis of the shaft 10 or the plate cylinder 12. The second projection 18, in a preferred embodiment, is in the form of a T-shaped member indicated at 22 and shown in somewhat greater detail in FIGS. 7 through 9. It will be seen from FIG. 1 however that the second projection 18 projects with respect to the end face 14 of the plate cylinder 12. The second projection 18 is fixed to the plate cylinder 12 by means of two screws shown in FIG. 1 and indicated at 20 in FIGS. 2 and 3, which engage into corresponding screwthreaded bores at the end face 14 of the plate cylinder 12. The two screws 20 extend through holes 26 provided on the head flange portion 24 of the second projection 18.

Reference numeral 30 in FIG. 3 denotes a collar which is disposed on the shaft 10 at a position beside the plate cylinder 12 which is also carried on the shaft 10, at a small spacing from the end face 14 at which the first and second projections 16 and 18 are disposed. The collar 30 is fixed to the shaft 10 by way of a radial pin indicated at 32 in FIG. 3 which for fixing purposes is cast using a suitable plastic material in a bore 34 in the collar 30. The collar 30 is of an annular configuration in cross-section and is provided with two flats which form flat surface portions 36, 37 extending in mutually right-angled relationship, as can be clearly seen from FIG. 4.

Figure 4:
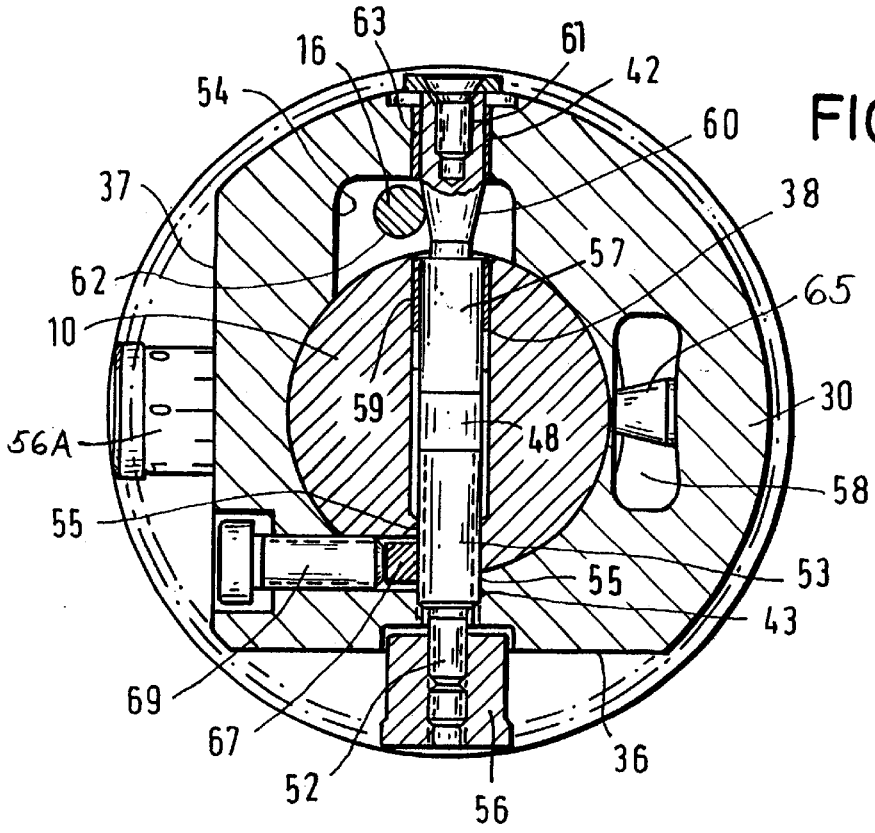
FIG. 4 shows a view in section taken along line IV—IV in FIG. 3.
Figure 5:
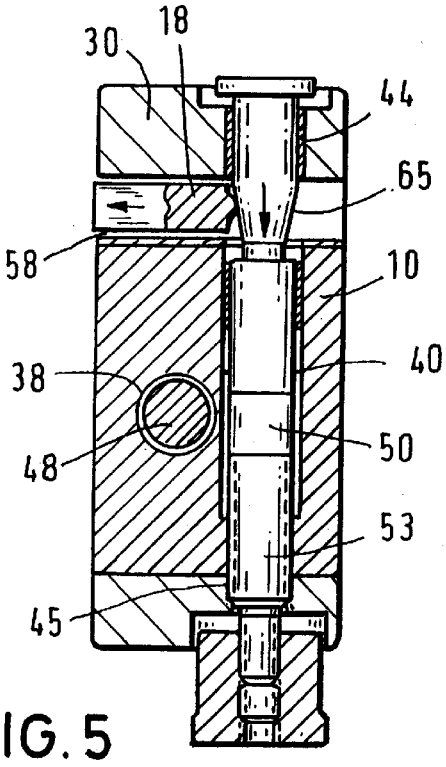
FIG. 5 shows a view in section taken along line V—V in FIG. 3.
Figure 6:
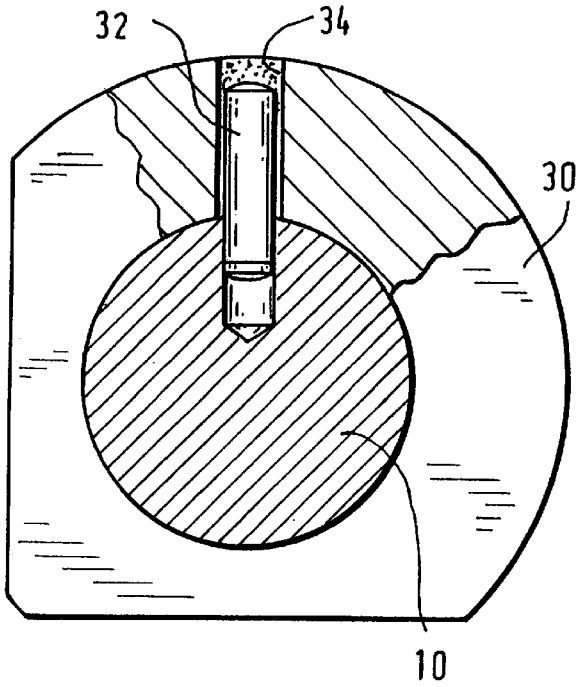
FIG. 6 shows a view in section taken along line VI—VI in FIG. 3.

In the region in which the collar 30 is disposed, the shaft 10 is provided with two substantially radial bores 38 and 40 which can be clearly seen from FIGS. 4 and 5. The bores 38, 40 are displaced relative to each other in the direction of the axial extent of the shaft 10 and extend substantially in right-angled relationship with each other. As can be seen from FIG. 4, the first bore 38 is continued at each end into a coaxial bore portion 42 and 43 respectively in the collar 30, in such a way that the bore 38 in the shaft 20 and the bore portions 42, 43 in the collar 30 supplement each other to form a continuous means for receiving a first adjusting bolt 48. In a corresponding manner, the second bore 40, at each end, is continued into a bore portion 44 and 45 respectively in the collar 30, in such a way that the second bore 40 and the bore portions 44, 45 are adapted to receive a second adjusting bolt 50.

As the two adjusting bolts 48 and 50 are of the same configuration and involve the same mode of operation, only the first adjusting bolt 48 will be described hereinafter.

Referring therefore now to FIG. 4, at its end which is towards the flat surface 36 in FIG. 4, the first adjusting bolt 48 has a portion 52 which projects with respect to the surface 36 of the collar 30 and which is provided with a first fixedly mounted adjusting knob 56, by means of which the adjusting bolt 48 can be turned about its longitudinal axis. Adjoining the smaller-diameter bolt portion 52 is a portion indicated at 53 in FIGS. 4 and 5 and which is provided on its outside with a screwthread engaging with a female screwthread indicated at 55 in Figure, which is provided in the bore portion 43 and in the portion of the bore 38, that is towards the adjusting knob 56. Adjoining the screwthreaded portion 53 is a bolt portion 57 without a screwthread, which is guided to achieve an accurate fit in a sleeve or bush indicated at 59 in FIG. 4. The sleeve or bush 59 is fitted in the region, remote from the adjusting knob 56, of the bore 38 which is within the shaft 10. Adjoining the bolt portion 57 is a conically tapering portion 60 which tapers towards the adjusting knob 56 and serves as an abutment. The conical portion 60 continues at its larger-diameter end into a shorter cylindrical bolt portion 61 which is mounted with a close fit, with the interposition of a sleeve or bush 63, in the bore portion 42 in the collar 30.

By virtue of the operative engagement between the male screwthread on the bolt portion 53 and the female screwthread portion 55 in the bore 38 in the shaft 10, rotation of the adjusting bolt 48 about its longitudinal axis, which is effected by turning the adjusting knob 56, at the same time results in axial displacement thereof with its conical portion 60, in one direction or the other.

Looking now at FIG. 3 and FIG. 4. the collar 30 is provided with a first recess or opening 54 which starts from the end face of the collar that faces towards the plate cylinder 12. This arrangement of the opening 54 can be particularly clearly seen in FIG. 3. The opening 54 is arranged in such a way that the conical portion 60 of the bolt 48 is disposed within the opening 54 into which, in the assembled condition of the components, the first projection 16 projects to determine the position of the plate cylinder in the peripheral direction relative to the shaft, as can be seen in particular from FIGS. 1 and 4. In this respect, the position at which the first projection 16 bears against the conical portion 60 of the bolt 48 (see FIG. 4) determines the position of the plate cylinder 12 in the peripheral direction. By virtue of the conical configuration of the bolt portion 60, axial displacement thereof also results in a corresponding change in position of the first projection 16 and thus the plate cylinder 12 in the peripheral direction so that suitable adjustment of the first adjusting bolt 48 and therewith the conical bolt portion 60 by way of the adjusting knob 56 can determine the position of the plate cylinder 12 in the peripheral direction.

The collar 30 is also provided with a second recess or opening which is indicated at 58 in FIGS. 4 and 5 and which is arranged to extend continuously through the structure in such a way that the conical portion 65 of the second adjusting bolt 50 is disposed within the second opening 58. The radial extent thereof can also be slightly greater than the radial extent of the operatively associated conically tapering bolt portion 65. Adjustment of the second adjusting bolt 50 and therewith the conical bolt portion 65 by way of the second adjusting knob 56A can determine the position of the plate cylinder 12 in the direction of the longitudinal axis of the shaft 10.

It will be noted that the extent of each of the two openings 54 and 58 in a plane transverse with respect to the longitudinal axis of the mounting shaft 10 is noticeably larger than the largest diameter of the respective conically tapering bolt portion 60 and 65 respectively.

A prerequisite to achieve the desired orientation of the plate cylinder 12 with respect to the shaft 10 is that, when the plate cylinder 12 is pushed on to the shaft 10, the two projections 16, 18 assume a position in the peripheral direction of the collar 30 such that they are disposed in opposite relationship to the respective openings 54 and 58 in the collar 30 and thus engage into the openings. In that respect, it is to be noted that the projection 16 is introduced into the opening 54 at the correct side of the conically tapering bolt portion 60, for properly establishing the position of the plate cylinder in the peripheral direction. As already indicated above. the axial movement involved in pushing the plate cylinder 12 on to the shaft 10 is limited by the end boundary face 64 encountering the conically tapering portion 65 of the second adjusting bolt 50, in which case contact between the end face 64 and the conically tapering bolt portion 65 determines the correct position of the plate cylinder 12. Thereafter, the plate cylinder 12 is turned about the shaft 10 to such an extent with respect to the shaft 10 until the first projection 16, which in a preferred embodiment is a pin, bears with its peripheral surface 62 against the conically tapering portion 60 of the first adjusting bolt 48. When that contact occurs, with contact between the second projection 18 and the conical portion 65 of the second adjusting bolt 50 being maintained at the same time, that is a guarantee that the plate cylinder is in the correct position relative to its support shaft 10.

The above-mentioned rotary movement of the plate cylinder 12 about its shaft 10, which is normally required for establishing its position in the peripheral direction, also results in a corresponding movement of the projection 18 with respect to the conically tapering bolt portion 65 so that the end face 64 of the second projection 18, which co-operates with the conically tapering bolt portion 65, should be of a peripheral extent which is not less than the magnitude of the maximum rotary movement which the plate cylinder experiences in order to bring the first projection 16 into contact with the conically tapering bolt portion 60 associated therewith.

Reference will now be made to the preferred embodiment of the second projection 18 as shown in FIGS. 8 and 9. FIGS. 8 and 9 show more particularly that the second projection 18 is of such a configuration as to be curved around the axis of rotation of the shaft 10, that is to say it extends in coaxial relationship with that axis of rotation. In that respect, as considered in longitudinal section through the second projection 18, or more specifically the end portion 66 thereof, the end face 64 is profiled in such a way that along a center circle 68 it has a projection as indicated at 70 in FIG. 9, thereby involving substantially punctiform contact between the end face 64 and the conical bolt portion 60. By virtue of the arcuate configuration of the projection 70 along the circle 68, the end face of the second projection 18 is always in contact, that is to say irrespective of the position of the second projection 18 in the peripheral direction, with the same point of the conical portion 65, and thus a movement of the second projection 18 about the axis of rotation of the shaft 10 and the plate cylinder 12 does not result in an axial change in position of the plate cylinder 12 on the shaft 10.

Associated with each of the two adjusting bolts 48, 50 is a more or less elastically deformable plastic body as indicated at 67 in FIG. 4, which is pressed against the screwthreaded bolt portion 53 by a screw 69 in FIG. 4 in order thereby to prevent unwanted rotation of the adjusting bolt 48 or 50 respectively and in order thus to secure the adjusting bolt in its set position. On the other hand, possibly after slackening of the screw 69, there is nonetheless the possibility of adjusting the adjusting bolt 48 or 50 respectively by manually rotating the respective adjusting knob 56 or 56A in order to adjust the respective conical portion 60 or 65, in accordance with the desired position for the plate cylinder 12 on its shaft 10. The screw 69 is carried in a screwthreaded bore within the collar 30.

After the above-described operation of orienting the plate cylinder 12 with respect to the shaft 10, the plate cylinder 12 is fixed on the shaft 10 by expansion of the latter. For that purpose, at least in the region in which it carries the plate cylinder 12, the shaft 10 is of a hollow structure and is filled with a hydraulic fluid. At the end of the shaft 10 which is remote from the two projections 16, 18 on the plate cylinder 12, the shaft 10 has a closure screw which is indicated at 74 in FIG. 3 having a male screwthread engaging into a corresponding female screwthread on the shaft 10. Actuation of the screw 74 by screwing it into or out of the hollow shaft consequently results in a reduction or an increase in the size of the internal space defined within the hollow shaft 10 and thus results in an increase in or a reduction in the pressure of the hydraulic fluid within the hollow region of the shaft 10. After the plate cylinder 12 has been moved on to the shaft 10 in the manner described hereinbefore and oriented with respect to the shaft by the action of the two conically tapering bolt portions 60, 65, the plate cylinder 12 is fixed on the shaft 10 by suitable actuation of the closure screw 74 in such a way that an increase in the pressure of the hydraulic fluid in the hollow region of the shaft causes the hollow shaft 10 to experience slight radial expansion, by means of which the plate cylinder 12 is suitably fixed on the shaft 10 in the mutually oriented positions thereof. To remove the shaft 10 it is then only necessary to rotate the closure screw 74 in such a way that there is a drop in the pressure of the hydraulic fluid within the shaft 10 and the shaft 10 thus experiences a reduction in diameter by virtue of its elastic nature and the clamping connection to the plate cylinder 12 is thus released.

It will be appreciated that the above-described embodiment of the invention has been set forth solely by way of example and illustration of the principles thereof and that various other modifications and alterations may be made therein without thereby departing from the spirit and scope of the invention.

What is claimed is:

1. A device for use in a rotary printing machine having at least one printing mechanism which includes:

a shaft having located thereon, a means for adjusting the orientation of a plate cylinder, said means for adjusting including a plurality of adjusting bolts having a conically tapering portion; and a plate cylinder releasably mounted on the shaft, said plate cylinder having a means for positioning; said means for adjusting adapted to engage the means for positioning so as to control the location of the plate cylinder with respect to the shaft, said means for positioning having a plurality of projections in contact with said conically tapering portion so as to adjust the position of the plate cylinder with respect to the shaft.

2. A device as set forth in claim 1 further comprising:

a collar fixedly mounted on the shaft beside the plate cylinder and having a side facing towards the plate cylinder, the collar at least at its side towards the plate cylinder including a first opening and a second opening into which a first and second projection extending from said plate cylinder engage in the operative position of the collar and the plate cylinder, wherein a conically tapering portion of a first adjusting bolt is disposed with said first opening and a conically tapering portion of a second adjusting bolt is disposed within said second opening.

3. A device as set forth in claim 2 wherein the shaft and collar are adapted to receive at least one adjusting bolt.

4. A device as set forth in claim 3 wherein the shaft and collar include:

a first bore portion in the collar;

a radial bore which extends through the shaft and which is coaxial with respect to said first bore portion;

a second bore portion in the collar which is coaxial with respect to said first bore portion and said radial bore; and a female screw thread in said radial bore in said shaft, the respectively associated adjusting bolt having a male screw thread co-operating with the associated female screw thread in the bore for adjustment of the position of a respective conically tapering portion located in the axial direction of the adjusting bolt.

5. A device as set forth in claim 4 wherein the conically tapering portion is an inclined portion.

6. A device as set forth in claim 1 wherein a first projection comprises a cylindrical pin having a peripheral surface which in an oriented position of the plate cylinder bears against a conically tapering portion of a first adjusting bolt, and a second projection comprises a T-shaped member having an end remote from the plate cylinder bearing against a conically tapering portion of a second adjusting bolt, said end defining a portion of an arc which is coaxial with the shaft and which is contactable with said conically tapering portion of the second adjusting bolt.

7. A device as set forth in claim 6 wherein said end is provided with a narrow coaxial projection to achieve substantially punctiform contact with said conically tapering portion of the second adjusting bolt.

8. A device for use in a rotary printing machine having at least one printing mechanism which includes:

a collar fixedly mounted on a shaft;

a plate cylinder releasably mounted on the shaft;

a first and second adjusting bolt disposed within said collar;

a first and second projection partially disposed within said plate cylinder and extending from the plate cylinder towards the collar;

said first projection in contact with a conically tapering portion of said first adjusting bolt so as to enable positioning of the plate cylinder in the peripheral direction; and said second projection in contact with a conically tapering portion of said second adjusting bolt so as to enable positioning of the plate cylinder in the peripheral direction.

9. A device as set forth in claim 8 wherein the collar is flattened at the side of the shaft which is in diametrally opposite relationship to the respective conically tapering portion to afford a flat peripheral surface portion.

10. A device as set forth in claim 8 wherein the conically tapering portion of the adjusting bolts are arranged displaced through about ninety degrees relative to each other.

11. A device as set forth in claim 8 wherein the shaft is hollow at least in the region in which it carries the plate cylinder, and being adapted to increase in diameter upon being subjected to hydraulic pressure exerted from within said hollow region.

* * * * *